US011170711B1

(12) United States Patent
Nie

(10) Patent No.: US 11,170,711 B1
(45) Date of Patent: Nov. 9, 2021

(54) PIXEL DRIVING CIRCUIT AND DISPLAY PANEL

(71) Applicant: Shenzhen China Star Optoelectronics Semiconductor Display Technology Co., Ltd., Guangdong (CN)

(72) Inventor: Chenglei Nie, Guangdong (CN)

(73) Assignee: SHENZHEN CHINA STAR OPTOELECTRONICS SEMICONDUCTOR DISPLAY TECHNOLOGY CO., LTD., Guangdong (CN)

( * ) Notice: Subject to any disclaimer, the term of this patent is extended or adjusted under 35 U.S.C. 154(b) by 310 days.

(21) Appl. No.: 16/496,641

(22) PCT Filed: May 24, 2019

(86) PCT No.: PCT/CN2019/088363

§ 371 (c)(1),
(2) Date: Sep. 23, 2019

(87) PCT Pub. No.: WO2020/211161

PCT Pub. Date: Oct. 22, 2020

(30) Foreign Application Priority Data

Apr. 19, 2019 (CN) ..... 201910319742.3

(51) Int. Cl.
*G09G 3/3225* (2016.01)

(52) U.S. Cl.
CPC ..... *G09G 3/3225* (2013.01); *G09G 2300/043* (2013.01); *G09G 2300/0819* (2013.01); *G09G 2320/0233* (2013.01); *G09G 2320/043* (2013.01)

(58) Field of Classification Search
CPC ..... G09G 3/3225; G09G 2300/043; G09G 2300/0819; G09G 2320/0233; G09G 2320/043; G09G 3/3208
See application file for complete search history.

(56) References Cited

U.S. PATENT DOCUMENTS

2014/0198085 A1* 7/2014 Park ..... G09G 3/3233 345/207
2016/0217728 A1* 7/2016 In ..... G09G 3/3266
2019/0164501 A1* 5/2019 Chai ..... G09G 3/3291

* cited by examiner

*Primary Examiner* — Dennis P Joseph

(57) ABSTRACT

A pixel driving circuit and a display panel are provided. The pixel driving circuit uses a 7T3C structure to effectively compensate a threshold voltage of a driving transistor in each pixel, a compensation structure of the pixel driving circuit is relatively simple, and operation difficulty is low. Moreover, a light emitting device emits light during a programming phase and an illumination phase, which increases light emitting time of the light emitting device, thereby improving a brightness and a life of the display panel.

20 Claims, 7 Drawing Sheets

PIXEL DRIVING CIRCUIT AND DISPLAY PANEL

FIELD OF INVENTION

The present disclosure relates to the field of display technologies, and more particularly to a pixel driving circuit and a display panel.

BACKGROUND OF INVENTION

Organic light emitting diode (OLED) display panels have advantages of high brightness, wide viewing angles, fast response, low power consumption, etc., and have been widely used in the field of high performance display. In the OLED display panel, pixels are arranged in a matrix including a plurality of rows and a plurality of columns, and each pixel is usually composed of two transistors and one capacitor, which is commonly called a 2T1C circuit, the transistor has an issue of threshold voltage drift, therefore, an OLED pixel driving circuit requires a corresponding compensation structure. At present, the compensation structure of the OLED pixel driving circuit is relatively complicated, an operation thereof is difficult, and light-emitting time of a light emitting device thereof is short.

SUMMARY OF INVENTION

An object of an embodiment of the present disclosure is to provide a pixel driving circuit and a display panel, which can solve technical problems that a compensation structure of a current pixel driving circuit is complicated, an operation thereof is difficult, and light emitting time of a light emitting device thereof is short.

An embodiment of the present disclosure provides a pixel driving circuit. The pixel driving circuit includes a first transistor, a second transistor, a third transistor, a fourth transistor, a fifth transistor, a sixth transistor, a seventh transistor, a first capacitor, a second capacitor, a third capacitor, and a light emitting device. A gate of the first transistor is electrically connected to a first node, a source of the first transistor is electrically connected to a second node, and a drain of the first transistor is electrically connected to a third node. A gate of the second transistor is electrically connected to a first control signal, a source of the second transistor is electrically connected to the second node, and a drain of the second transistor is electrically connected to the third node. A gate of the third transistor is electrically connected to a fourth node, a source of the third transistor is electrically connected to a first power signal, and a drain of the third transistor is electrically connected to the second node. A gate of the fourth transistor is electrically connected to a second control signal, a source of the fourth transistor is electrically connected to the first power signal, and a drain of the fourth transistor is electrically connected to the fourth node. A gate of the fifth transistor is electrically connected to the first control signal, a source of the fifth transistor is electrically connected to the first node, and a drain of the fifth transistor is electrically connected to the third node. A gate of the sixth transistor is electrically connected to a third control signal, a source of the sixth transistor is electrically connected to a data signal, and a drain of the sixth transistor is electrically connected to the first node. A gate of the seventh transistor is electrically connected to a fourth control signal, a source of the seventh transistor is electrically connected to a reference signal, and a drain of the seventh transistor is electrically connected to the third node. A first end of the first capacitor is electrically connected to the second node, and a second end of the first capacitor is electrically connected to the fourth node. A first end of the second capacitor is electrically connected to the first node, and a second end of the second capacitor is electrically connected to the third node. A first end of the third capacitor is electrically connected to the third node, and a second end of the third capacitor is electrically connected to a second power signal. An anode of the light emitting device is electrically connected to the third node, and a cathode of the light emitting device is electrically connected to the second power signal. The first transistor, the second transistor, the third transistor, the fourth transistor, the fifth transistor, the sixth transistor, and the seventh transistor are all low temperature polysilicon thin film transistors, oxide semiconductor thin film transistors, or amorphous silicon thin film transistors, and the light emitting device is an organic light emitting diode.

In an embodiment of the present disclosure, a combination of the first control signal, the second control signal, the third control signal, and the fourth control signal sequentially corresponds to an initialization phase, a threshold voltage detection phase, a data signal input phase, a programming phase, and an illumination phase, the data signal comprises a reference potential and a display potential, in the initialization phase and the threshold voltage detection phase, a potential of the data signal is the reference potential, and in the data signal input phase, a potential of the data signal is the display potential.

In an embodiment of the present disclosure, in the initialization phase, the first control signal is at a low potential, the second control signal is at a high potential, the third control signal is at a high potential, and the fourth control signal is at a high potential.

In an embodiment of the present disclosure, in the threshold voltage detection phase, the first control signal is at a low potential, the second control signal is at a high potential, the third control signal is at a high potential, and the fourth control signal is at a low potential.

In an embodiment of the present disclosure, in the data signal input phase, the first control signal is at a low potential, the second control signal is at a high potential, the third control signal is at a high potential, and the fourth control signal is at a low potential.

In an embodiment of the present disclosure, in the programming phase, the first control signal is at a low potential, the second control signal is at a high potential, the third control signal is at a low potential, and the fourth control signal is at a low potential.

In an embodiment of the present disclosure, in the illumination phase, the first control signal is at a high potential, the second control signal is at a low potential, the third control signal is at a low potential, and the fourth control signal is at a low potential.

An embodiment of the present disclosure further includes a pixel driving circuit. The pixel driving circuit includes a first transistor, a second transistor, a third transistor, a fourth transistor, a fifth transistor, a sixth transistor, a seventh transistor, a first capacitor, a second capacitor, a third capacitor, and a light emitting device. A gate of the first transistor is electrically connected to a first node, a source of the first transistor is electrically connected to a second node, and a drain of the first transistor is electrically connected to a third node. A gate of the second transistor is electrically connected to a first control signal, a source of the second transistor is electrically connected to the second node, and a drain of the second transistor is electrically connected to the third node. A gate of the third transistor is electrically connected to a fourth node, a source of the third transistor is electrically connected to a first power signal, and a drain of the third transistor is electrically connected to the second node. A gate of the fourth transistor is electrically connected to a second control signal, a source of the fourth transistor is electrically connected to the first power signal, and a drain of the fourth transistor is electrically connected to the fourth node. A gate of the fifth transistor is electrically connected to the first control signal, a source of the fifth transistor is electrically connected to the first node, and a drain of the fifth transistor is electrically connected to the third node. A gate of the sixth transistor is electrically connected to a third control signal, a source of the sixth transistor is electrically connected to a data signal, and a drain of the sixth transistor is electrically connected to the first node. A gate of the seventh transistor is electrically connected to a fourth control signal, a source of the seventh transistor is electrically connected to a reference signal, and a drain of the seventh transistor is electrically connected to the third node. A first end of the first capacitor is electrically connected to the second node, and a second end of the first capacitor is electrically connected to the fourth node. A first end of the second capacitor is electrically connected to the first node, and a second end of the second capacitor is electrically connected to the third node. A first end of the third capacitor is electrically connected to the third node, and a second end of the third capacitor is electrically connected to a second power signal. An anode of the light emitting device is electrically connected to the third node, and a cathode of the light emitting device is electrically connected to the second power signal.

In an embodiment of the present disclosure, a combination of the first control signal, the second control signal, the third control signal, and the fourth control signal sequentially corresponds to an initialization phase, a threshold voltage detection phase, a data signal input phase, a programming phase, and an illumination phase, the data signal comprises a reference potential and a display potential, in the initialization phase and the threshold voltage detection phase, a potential of the data signal is the reference potential, and in the data signal input phase, a potential of the data signal is the display potential.

In an embodiment of the present disclosure, in the initialization phase, the first control signal is at a low potential, the second control signal is at a high potential, the third control signal is at a high potential, and the fourth control signal is at a high potential.

In an embodiment of the present disclosure, in the threshold voltage detection phase, the first control signal is at a low potential, the second control signal is at a high potential, the third control signal is at a high potential, and the fourth control signal is at a low potential.

In an embodiment of the present disclosure, in the data signal input phase, the first control signal is at a low potential, the second control signal is at a high potential, the third control signal is at a high potential, and the fourth control signal is at a low potential.

In an embodiment of the present disclosure, in the programming phase, the first control signal is at a low potential, the second control signal is at a high potential, the third control signal is at a low potential, and the fourth control signal is at a low potential.

In an embodiment of the present disclosure, in the illumination phase, the first control signal is at a high potential, the second control signal is at a low potential, the third control signal is at a low potential, and the fourth control signal is at a low potential.

In an embodiment of the present disclosure, the first transistor, the second transistor, the third transistor, the fourth transistor, the fifth transistor, the sixth transistor, and the seventh transistor are all low temperature polysilicon thin film transistors, oxide semiconductor thin film transistors, or amorphous silicon thin film transistors.

In an embodiment of the present disclosure, the light emitting device is an organic light emitting diode.

In an embodiment of the present disclosure, a display panel includes a pixel driving circuit. The pixel driving circuit includes a first transistor, a second transistor, a third transistor, a fourth transistor, a fifth transistor, a sixth transistor, a seventh transistor, a first capacitor, a second capacitor, a third capacitor, and a light emitting device. A gate of the first transistor is electrically connected to a first node, a source of the first transistor is electrically connected to a second node, and a drain of the first transistor is electrically connected to a third node. A gate of the second transistor is electrically connected to a first control signal, a source of the second transistor is electrically connected to the second node, and a drain of the second transistor is electrically connected to the third node. A gate of the third transistor is electrically connected to a fourth node, a source of the third transistor is electrically connected to a first power signal, and a drain of the third transistor is electrically connected to the second node. A gate of the fourth transistor is electrically connected to a second control signal, a source of the fourth transistor is electrically connected to the first power signal, and a drain of the fourth transistor is electrically connected to the fourth node. A gate of the fifth transistor is electrically connected to the first control signal, a source of the fifth transistor is electrically connected to the first node, and a drain of the fifth transistor is electrically connected to the third node. A gate of the sixth transistor is electrically connected to a third control signal, a source of the sixth transistor is electrically connected to a data signal, and a drain of the sixth transistor is electrically connected to the first node. A gate of the seventh transistor is electrically connected to a fourth control signal, a source of the seventh transistor is electrically connected to a reference signal, and a drain of the seventh transistor is electrically connected to the third node. A first end of the first capacitor is electrically connected to the second node, and a second end of the first capacitor is electrically connected to the fourth node. A first end of the second capacitor is electrically connected to the first node, and a second end of the second capacitor is electrically connected to the third node. A first end of the third capacitor is electrically connected to the third node, and a second end of the third capacitor is electrically connected to a second power signal. An anode of the light emitting device is electrically connected to the third node, and a cathode of the light emitting device is electrically connected to the second power signal.

In an embodiment of the present disclosure, a combination of the first control signal, the second control signal, the third control signal, and the fourth control signal sequentially corresponds to an initialization phase, a threshold voltage detection phase, a data signal input phase, a programming phase, and an illumination phase, the data signal comprises a reference potential and a display potential, in the initialization phase and the threshold voltage detection phase, a potential of the data signal is the reference potential, and in the data signal input phase, a potential of the data signal is the display potential.

In an embodiment of the present disclosure, in the initialization phase, the first control signal is at a low potential, the second control signal is at a high potential, the third control signal is at a high potential, and the fourth control signal is at a high potential.

In an embodiment of the present disclosure, in the threshold voltage detection phase, the first control signal is at a low potential, the second control signal is at a high potential, the third control signal is at a high potential, and the fourth control signal is at a low potential.

Beneficial effects of an embodiment of the present disclosure are that, the embodiment provides a pixel driving circuit and a display panel. The pixel driving circuit uses a 7T3C structure to effectively compensate a threshold voltage of a driving transistor in each pixel, a compensation structure of the pixel driving circuit is relatively simple, and operation difficulty is low. Moreover, a light emitting device emits light during a programming phase and an illumination phase, which increases light emitting time of the light emitting device, thereby improving a brightness and a life of the display panel.

DESCRIPTION OF DRAWINGS

In order to more clearly illustrate the technical solutions in the embodiments of the present disclosure, the drawings used in the description of the embodiments will be briefly described below. It is obvious that the drawings in the following description are only some embodiments of the present disclosure. Other drawings can also be obtained from those skilled in the art based on these drawings without paying any creative effort.

DETAILED DESCRIPTION OF PREFERRED EMBODIMENTS

Figure 1:
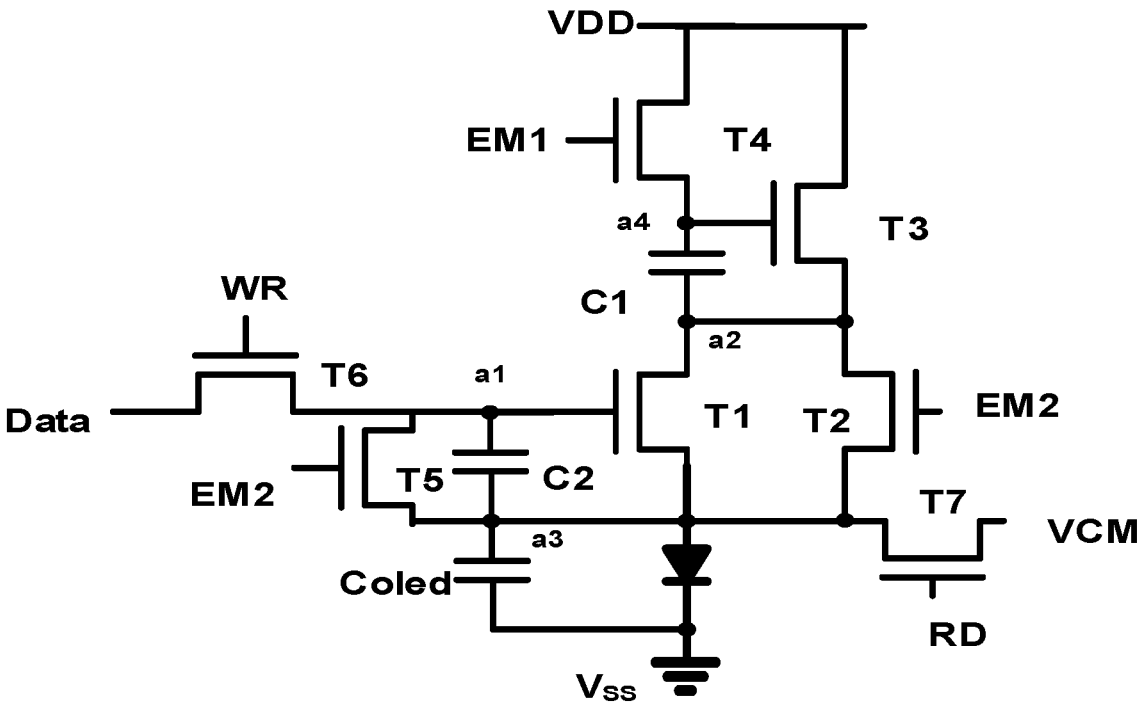
FIG. 1 is a schematic structural diagram of a pixel driving circuit according to an embodiment of the present disclosure.

The technical solutions in the embodiments of the present disclosure will be clearly and completely described in the following with reference to the accompanying drawings in the embodiments. It is apparent that the described embodiments are only a part of the embodiments of the present disclosure, and not all of them. All other embodiments obtained by a person skilled in the art based on the embodiments of the present disclosure without creative efforts are within the scope of the present disclosure.

Transistors used in all embodiments of the present disclosure may be thin film transistors, field effect transistors, or other devices having the same characteristics. Since sources and drains of the transistors used herein are symmetrical, the sources and the drains are interchangeable. In some embodiments of the present disclosure, in order to distinguish two poles of a transistor except a gate, one of the poles is referred to as a source and the other pole is referred to as a drain. According to the form in the drawing, a middle end of a switching transistor is a gate, a signal input end is a source, and an output end is a drain. In addition, the transistor used in the embodiment of the present disclosure may include two types of P-type transistors and/or N-type transistors. The P-type transistor is turned on when the gate is at a low potential and is turned off when the gate is at a high potential, and the N-type transistor is turned on when the gate is at a high potential and is turned off when the gate is at a low potential.

Refer to FIG. 1, a schematic structural diagram of a pixel driving circuit according to an embodiment of the present disclosure is provided. As illustrated in FIG. 1, a pixel driving circuit provided by an embodiment of the present disclosure includes a first transistor T1, a second transistor T2, a third transistor T3, a fourth transistor T4, a fifth transistor T5, a sixth transistor T6, a seventh transistor T7, a first capacitor C1, a second capacitor C2, a third capacitor Coled, and a light emitting device D. The light emitting device D may be an organic light emitting diode. That is, the pixel driving circuit using a 7T3C structure effectively compensates a threshold voltage of the driving transistor in each pixel, uses fewer components, has a simple and stable structure, and saves cost. The first transistor T1 in the pixel driving circuit is a driving transistor.

A gate of the first transistor T1 is electrically connected to a first node a1, a source of the first transistor T1 is electrically connected to a second node a2, and a drain of the first transistor T1 is electrically connected to a third node a3. A gate of the second transistor T2 is electrically connected to a first control signal EM2, a source of the second transistor T2 is electrically connected to the second node a2, and a drain of the second transistor T2 is electrically connected to the third node a3. A gate of the third transistor T3 is electrically connected to a fourth node a4, a source of the third transistor T3 is electrically connected to a first power supply signal VDD, and a drain of the third transistor T3 is electrically connected to the second node a2. A gate of the fourth transistor T4 is electrically connected to a second control signal EM1, a source of the fourth transistor T4 is electrically connected to a first power signal VDD, and a drain of the fourth transistor T4 is electrically connected to the fourth node a4. A gate of the fifth transistor T5 is electrically connected to the first control signal EM2, a source of the fifth transistor T5 is electrically connected to the first node a1, and a drain of the fifth transistor T5 is electrically connected to the third node a3. A gate of the sixth transistor T6 is electrically connected to a third control signal WR, a source of the sixth transistor T6 is electrically connected to a data signal Data, and a drain of the sixth transistor T6 is electrically connected to the first node a1. A gate of the seventh transistor T7 is electrically connected to a fourth control signal RD, a source of the seventh transistor T7 is electrically connected to a reference signal VCM, and a drain of the seventh transistor T7 is electrically connected to the third node a3. A first end of the first capacitor C1 is electrically connected to the second node a2, and a second end of the first capacitor C1 is electrically connected to the fourth node a4. A first end of the second capacitor C2 is electrically connected to the first node a1, and a second end of the second capacitor C2 is electrically connected to the third node a3. A first end of the third capacitor Coled is electrically connected to the third node a3, and a second end of the third capacitor Coled is electrically connected to a second power signal Vss. An anode end of the light emitting device D is electrically connected to the third node a3, and a cathode end of the light emitting device D is electrically connected to the second power signal Vss.

In some embodiments, the first transistor T1, the second transistor T2, the third transistor T3, the fourth transistor T4, the fifth transistor T5, the sixth transistor T6, and the seventh transistor T7 are all low temperature polysilicon thin film transistors, oxide semiconductor thin film transistors, or amorphous silicon thin film transistors. The transistors in the pixel driving circuit provided by the embodiments of the present disclosure are the same type of transistors, thereby avoiding an influence of a difference between different types of transistors on the pixel driving circuit.

Figure 2:
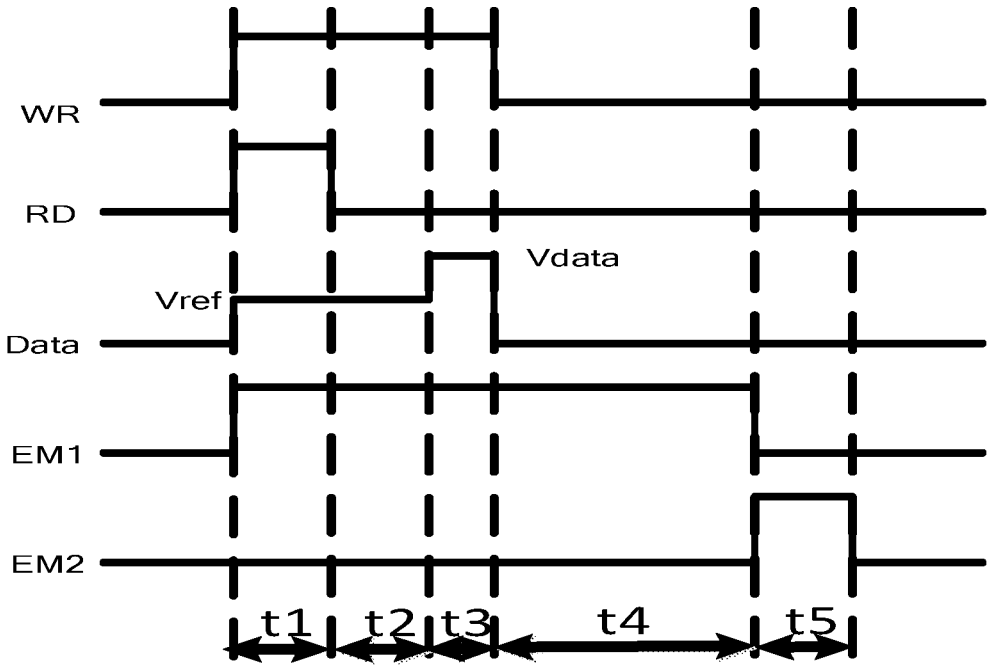
FIG. 2 is a timing diagram of a pixel driving circuit according to an embodiment of the present disclosure.

Refer to FIG. 2, a timing diagram of a pixel driving circuit according to an embodiment of the present disclosure is provided. As illustrated in FIG. 2, a combination of the first control signal EM2, the second control signal EM1, the third control signal WR, and the fourth control signal RD sequentially corresponds to an initialization phase t1, a threshold voltage detection phase t2, a data signal input phase t3, a programming phase t4, and an illumination phase t5. The data signal Data includes a reference potential Vref and a display potential Vdata, and a value of the reference potential Vref is smaller than a value of the display potential Vdata. In the initialization phase t1 and the threshold voltage detection phase t2, a potential of the data signal Data is the reference potential Vref, and in the data signal input phase t3, a potential of the data signal Data is the display potential Vdata. It should be noted that the light emitting device D of the embodiment of the present disclosure emits light during the programming phase t4 and the illumination phase t5, thereby increasing light emitting time of the light emitting device D, thereby improving a brightness and a life of the display panel.

In some embodiments of the present disclosure, in the initialization phase t1, the first control signal EM2 is at a low potential, the second control signal EM1 is at a high potential, the third control signal WR is at a high potential, and the fourth control signal RD is at a high potential.

In some embodiments of the present disclosure, in the threshold voltage detection phase t2, the first control signal EM2 is at a low potential, the second control signal EM1 is at a high potential, the third control signal WR is at a high potential, and the fourth control signal RD is at a low potential.

In some embodiments of the present disclosure, in the data signal input phase t3, the first control signal EM2 is at a low potential, the second control signal EM1 is at a high potential, the third control signal WR is at a high potential, and the fourth control signal RD is at a low potential.

In some embodiments of the present disclosure, in the programming phase t4, the first control signal EM2 is at a low potential, the second control signal EM1 is at a high potential, the third control signal WR is at a low potential, and the fourth control signal RD is at a low potential.

In some embodiments of the present disclosure, in the illumination phase t5, the first control signal EM2 is at a high potential, the second control signal EM1 is at a low potential, the third control signal WR is at a low potential, and the fourth control signal RD is at a low potential.

Further, the first power signal VDD and the second power signal Vss are both DC voltage sources, and the potential of the first power signal VDD is greater than the potential of the second power signal Vss.

Figure 3:
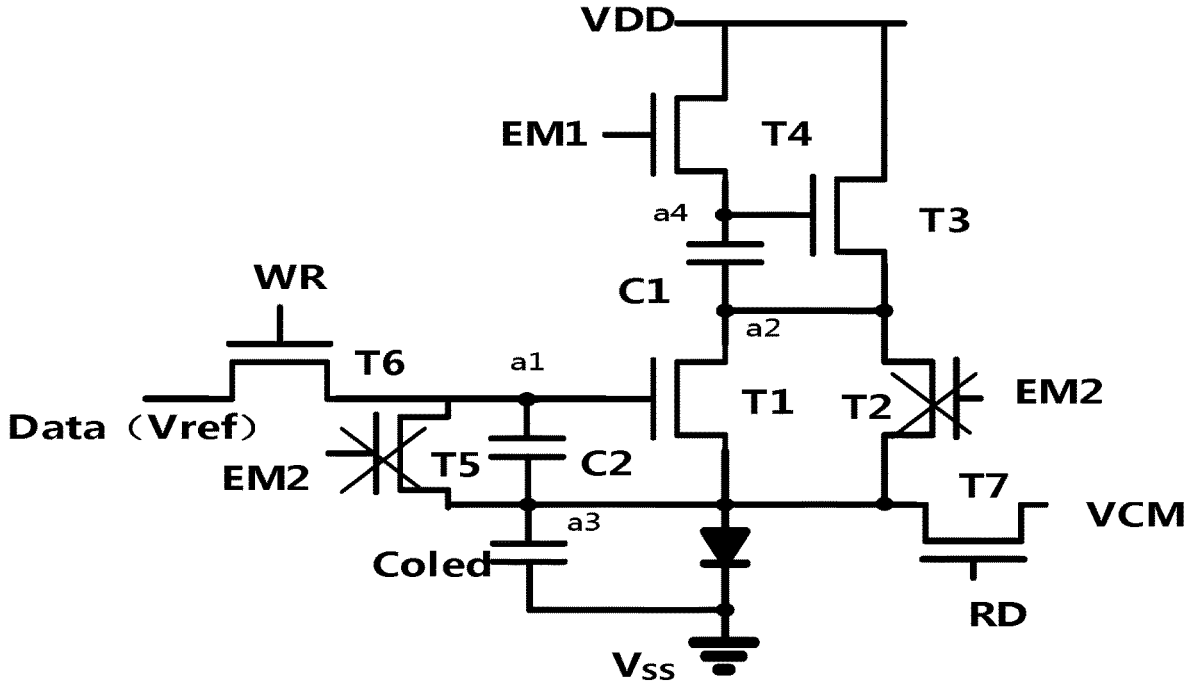
FIG. 3 is a schematic diagram of a path of a pixel driving circuit provided in an embodiment of the present disclosure in an initialization phase of a driving sequence illustrated in FIG. 2.

Refer to FIG. 3, a schematic diagram of a path of a pixel driving circuit provided in an embodiment of the present disclosure in an initialization phase of a driving sequence illustrated in FIG. 2 is provided. First, as illustrated in FIG. 2 and FIG. 3, in the initialization phase t1, the first control signal EM2 is at a low potential, the second control signal EM1 is at a high potential, the third control signal WR is at a high potential, and the fourth control signal RD is at a high potential. At this time, the first transistor T1, the third transistor T3, the fourth transistor T4, the sixth transistor T6, and the seventh transistor T7 are turned on, and the second transistor T2 and the fifth transistor T5 are turned off.

In details, since the fourth control signal RD is at a high potential, the seventh transistor T7 is turned on, and the reference signal VCM is output to the third node a3 via the seventh transistor, that is, at this time, the drain of the first transistor is charged to the potential of the reference signal VCM. Since the third control signal WR is at a high potential, the sixth transistor T6 is turned on, and the reference potential Vref of the data signal Data is output to the first node a1 via the sixth transistor T6, that is, at this time, the gate of the first transistor T1 is charge to the reference potential Vref. The first transistor T1 is initialized.

In addition, since the second control signal EM1 is at a high potential, the fourth transistor T4 is turned on, and the first power signal VDD is output to the fourth node a4 via the fourth transistor T4 and stored in the first capacitor C1. Since the fourth node a4 is electrically connected to the gate of the third transistor T3, the third transistor T3 is turned on, and the first power signal VDD is output to the second node a2 via the third transistor T3 and stored in the first capacitor C1. That is, at this time, the third transistor T3 and the fourth transistor T4 supply respective voltages to the source of the first transistor T1, and at this time, the first transistor T1 is turned on. Since the first control signal EM2 is at a low potential, the second transistor T2 and the fifth transistor T5 are turned off.

Figure 4:
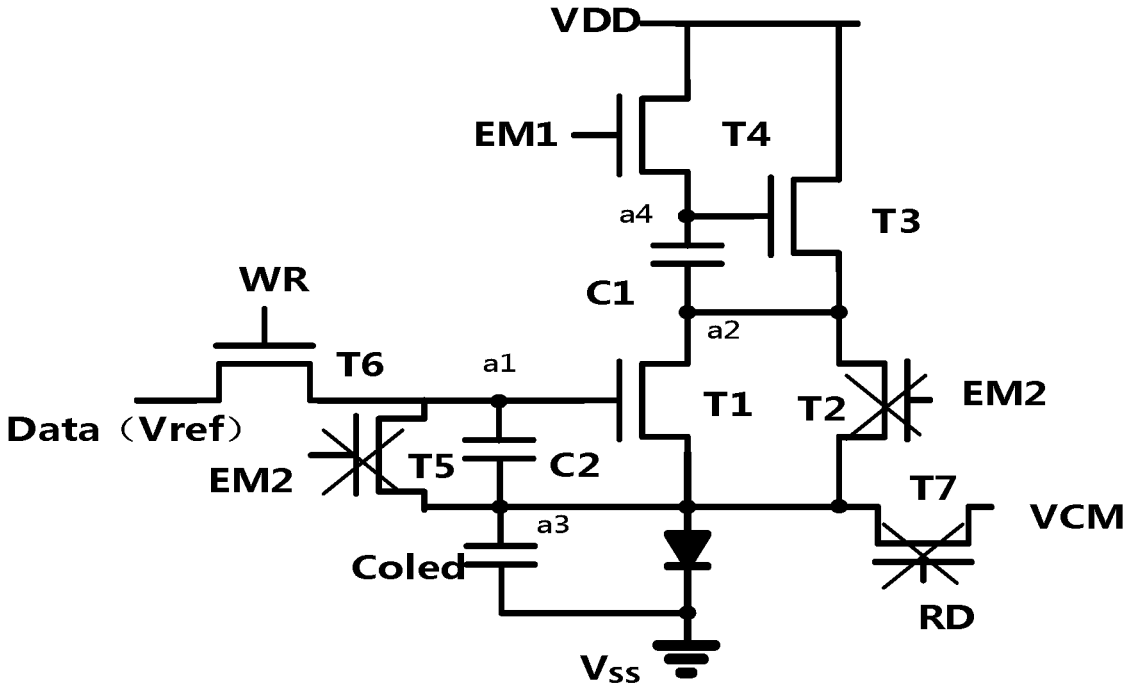
FIG. 4 is a schematic diagram of a path of a pixel driving circuit provided in an embodiment of the present disclosure in a signal input phase and a threshold voltage detection phase of a driving sequence illustrated in FIG. 2.

Refer to FIG. 4, a schematic diagram of a path of a pixel driving circuit provided in an embodiment of the present disclosure in a signal input phase and a threshold voltage detection phase of a driving sequence illustrated in FIG. 2 is provided. As illustrated in FIG. 2 and FIG. 4, in the threshold voltage detection phase t2, the first control signal EM2 is at a low potential, the second control signal EM1 is at a high potential, the third control signal WR is at a high potential, and the fourth control signal RD is at a low potential. At this time, the third transistor T3, the fourth transistor T4, and the sixth transistor T6 are turned on, and the second transistor T2, the fifth transistor T5, and the seventh transistor T7 are turned off. After the voltage difference between the gate and the source of the first transistor T1 drops to a certain value, the first transistor T1 is turned off. That is, the first transistor T1 is turned from the on state to the off state in the threshold voltage detection phase t2.

In details, since the third control signal WR is at a high potential, the sixth transistor T6 is turned on, and the reference potential Vref of the data signal Data is output to the first node a1 via the sixth transistor T6 and is stored in the first capacitor C1. That is, at this time, the potential of the first end of the first capacitor C1 remains unchanged during the initialization phase t1 while the potential of the first end of the first capacitor C1 remains.

Since the second control signal EM1 is at a high potential, the fourth transistor T4 is turned on, and the first power signal VDD is output to the fourth node a4 via the fourth transistor T4 and stored in the first capacitor C1. Since the fourth node a4 is electrically connected to the gate of the third transistor T3, the third transistor T3 is turned on, and the first power signal VDD is output to the second node a2 via the third transistor T3 and stored in the first capacitor C1. That is, at this time, the third transistor T3 and the fourth transistor T4 supply respective voltages to the source of the first transistor T1, and at this time, the first transistor T1 is turned on.

At the same time, since the fourth control signal RD is at a low potential, the seventh transistor T7 is turned off, the drain of the first transistor T1 is in a floating state, and the source of the first transistor T1 is continuously charged until the potential of the drain of the first transistor T1 I is equal to Vref−Vth, where Vth is the threshold voltage of the first transistor T1. At this time, the threshold voltage of the first transistor T1 is successfully detected and stored in the drain of the first transistor T1. In addition, since the first control signal EM2 is at a low potential, the second transistor T2 and the fifth transistor T5 are turned off.

Figure 5:
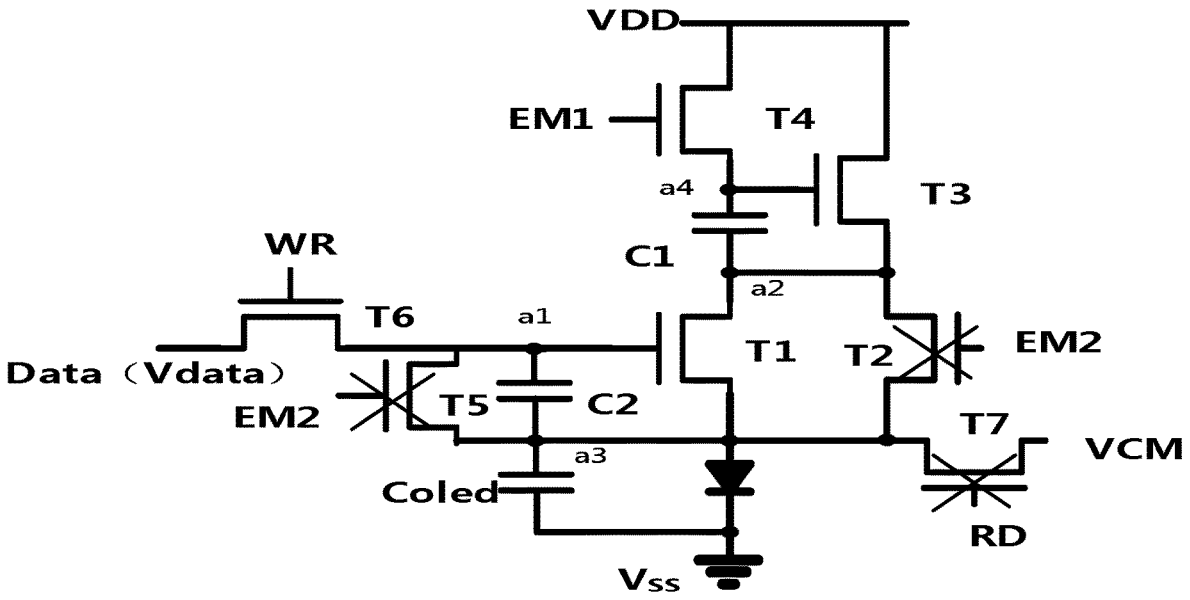
FIG. 5 is a schematic diagram of a path of a pixel driving circuit provided in an embodiment of the present disclosure in a data signal input phase of a driving sequence illustrated in FIG. 2.

Next, refer to FIG. 5. a schematic diagram of a path of a pixel driving circuit provided in an embodiment of the present disclosure in a data signal input phase of a driving sequence illustrated in FIG. 2 is provided. As illustrated in FIG. 2 and FIG. 5, in the data signal input phase t3, the first control signal EM2 is at a low potential, the second control signal EM1 is at a high potential, the third control signal WR is at a high potential, and the fourth control signal RD is at a low potential. At this time, the third transistor T3, the fourth transistor T4, and the sixth transistor T6 are turned on, and the second transistor T2, the fifth transistor T5, and the seventh transistor T7 are turned off. The first transistor T1 is turned from the off state to the on state at the data signal input phase t3.

In details, since the third control signal WR is at a high potential, the sixth transistor T6 is turned on, and the display potential Vdata of the data signal Data is output to the first end of the first capacitor C1 via the sixth transistor T6. Due to the capacitive coupling effect, the second end of the first capacitor C2 may also change accordingly. At this time, the voltage of the second end of the first capacitor C1 is Vref−Vth+(Vdata−Vref)×C2/(C2+Coled). That is, the voltage Vref−Vth+(Vdata−Vref)×C2/(C2+Coled) of the drain of the first transistor T1, so far, the threshold voltage of the first transistor T1 and the display potential Vdata of the data signal Data are successfully stored. At the drain of the first transistor T1.

Figure 6:
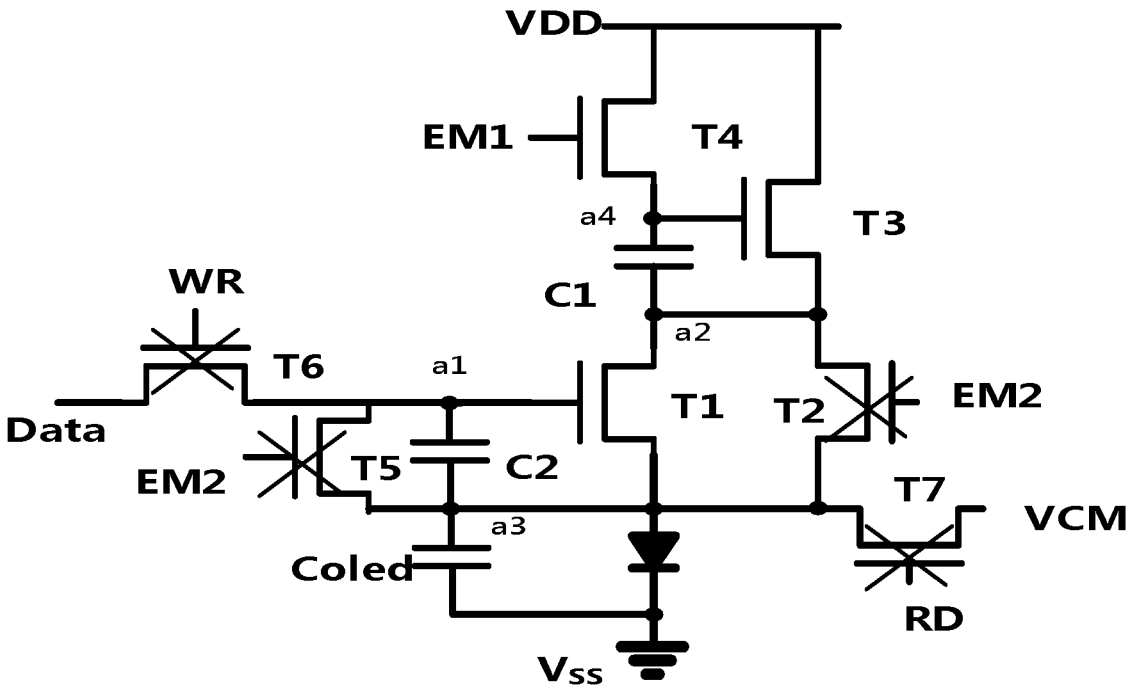
FIG. 6 is a schematic diagram of a path of a pixel driving circuit provided in an embodiment of the present disclosure in a programming phase of a driving sequence illustrated in FIG. 2.

Subsequently, refer to FIG. 6, a schematic diagram of a path of a pixel driving circuit provided in an embodiment of the present disclosure in a programming phase of a driving sequence illustrated in FIG. 2 is provided. Refer to FIG. 2 and FIG. 6, in the programming phase t4, the first control signal EM2 is at a low potential, the second control signal EM1 is at a high potential, the third control signal WR is at a low potential, and the fourth control signal RD is at a low potential. At this time, the first transistor T1, the third transistor T3, and the fourth transistor T4 are turned on, and the second transistor T2, the fifth transistor T5, the sixth transistor T6, and the seventh transistor T7 are turned off.

In details, due to the action of the second capacitor C2, the potential of the gate of the first transistor T1 maintains the potential of the gate of the first transistor T1 when the data signal is input to the measurement phase t3.

Since the second control signal EM1 is at a high potential, the fourth transistor T4 is turned on, and the first power signal VDD is output to the fourth node a4 via the fourth transistor T4 and stored in the first capacitor C1. Since the fourth node a4 is electrically connected to the gate of the third transistor T3, the third transistor T3 is turned on, and the first power signal VDD is output to the second node a2 via the third transistor T3 and stored in the first capacitor C1. Further, the voltage difference between the gate and the drain of the third transistor T3 is gradually adjusted to be compatible with the current of the light emitting device D, and the light emitting device D can normally emit light. In addition, since the first control signal EM2, the third control signal WR, and the fourth control signal RD are both at a low potential, the second transistor T2, the fifth transistor T5, the sixth transistor T6, and the seventh transistor T7 are turned off.

Figure 7:
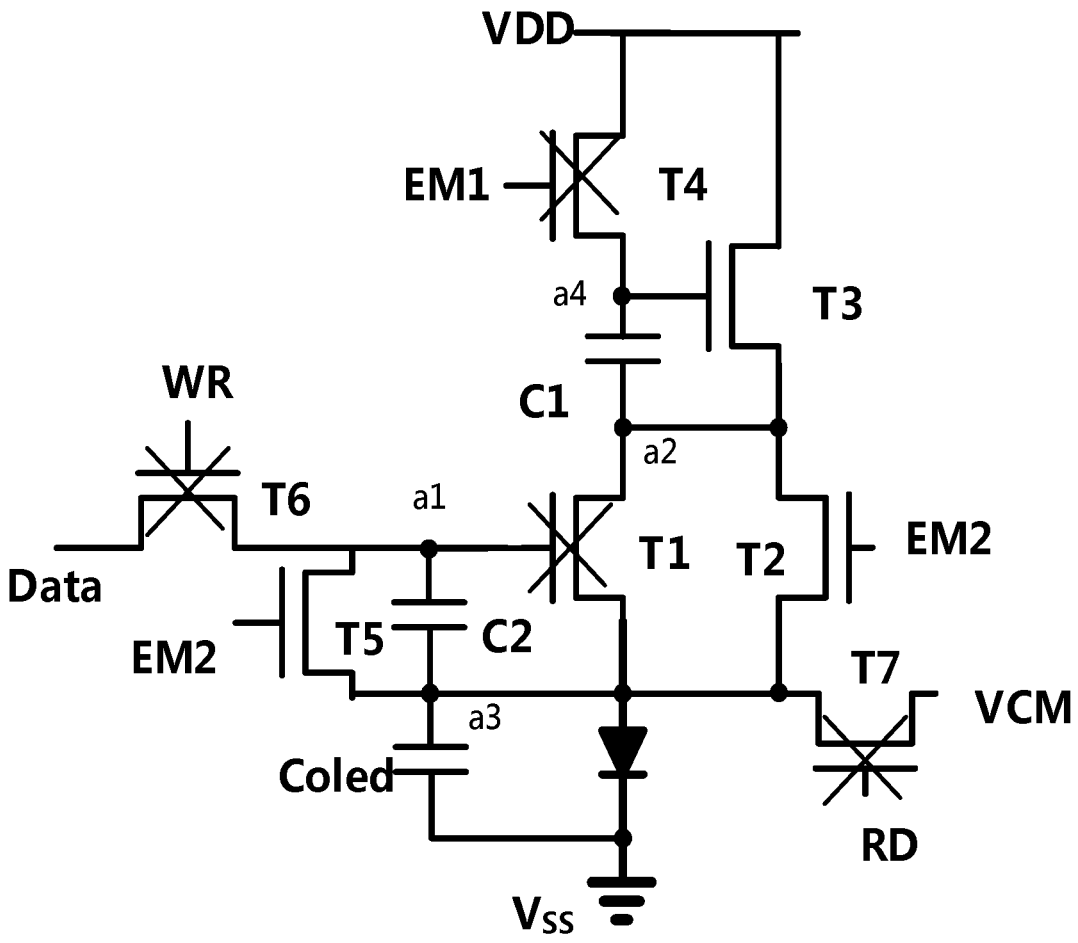
FIG. 7 is a schematic diagram of a path of a pixel driving circuit provided in an embodiment of the present disclosure in an illumination phase of a driving sequence illustrated in FIG. 2.

Finally, refer to FIG. 7, a schematic diagram of a path of a pixel driving circuit provided in an embodiment of the present disclosure in an illumination phase of a driving sequence illustrated in FIG. 2 is provided. Refer to FIG. 2 and FIG. 7, in the illumination phase t5, the first control signal EM2 is at a high potential, the second control signal EM1 is at a low potential, the third control signal WR is at a low potential, and the fourth control signal RD is at a low potential. At this time, the second transistor T2, the third transistor T3, and the fifth transistor T5 are turned on, and the first transistor T1, the fourth transistor T4, the sixth transistor T6, and the seventh transistor T7 are turned off.

In details, since the third control signal WR is at a low potential, the sixth transistor T6 is turned off. Since the first control signal EM2 is at a high potential, the fifth transistor T5 is turned on, thereby causing the first node a1 to be short-circuited with the third node a3, and the first transistor T1 is turned off.

Since the second control signal EM1 is at a low potential, the fourth transistor T4 is turned off. However, due to the action of the first capacitor C1, the potential of the fourth node a4 remains at the potential of the fourth node at the programming phase t4. Since the fourth node a4 is electrically connected to the gate of the third transistor T3, the third transistor T3 is also turned on at this time, and the first power signal VDD is output to the second node a2 via the third transistor T3. That is, at this time, the voltage difference between the gate and the drain of the third transistor T3 is maintained by the first capacitor C1, and the voltage difference between the gate and the drain of the third transistor T3 is still at the programming stage t4, thereby ensuring that the current flowing through the light emitting device D does not change.

In addition, since the first control signal EM2 is at a high potential, the second transistor T2 and the fifth transistor T5 are turned on. Since the fifth transistor T5 is turned on, the gate and the drain of the first transistor T1 are shorted, so that the voltage difference between the gate and the drain of the first transistor T1 approaches zero. At this time, the first transistor T1 has no stress. That is, the current flowing through the light emitting device D is independent of the threshold voltage of the first transistor T1. Since the fifth transistor T5 is turned on, the current originally flowing through the first transistor T1 now flows to the light emitting device D through the fifth transistor T5 without affecting the normal light emission of the light emitting device D.

The embodiment of the present disclosure further provides a display panel, which includes the above-mentioned pixel driving circuit. For details, refer to the description of the pixel driving circuit, and no further details are provided herein.

In the embodiments, a pixel driving circuit and a display panel are provided. The pixel driving circuit uses a 7T3C structure to effectively compensate a threshold voltage of a driving transistor in each pixel, a compensation structure of the pixel driving circuit is relatively simple, and operation difficulty is low. Moreover, a light emitting device emits light during a programming phase and an illumination phase, which increases light emitting time of the light emitting device, thereby improving a brightness and a life of the display panel.

The above are only the embodiments of the present disclosure and are not intended to limit the scope of the present disclosure, and the equivalent structure or equivalent process transformations made by the description of the present disclosure and the drawings are directly or indirectly applied to other related technical fields. The same is included in the scope protection of the present disclosure.

What is claimed is:

1. A pixel driving circuit, comprising:

a first transistor, a second transistor, a third transistor, a fourth transistor, a fifth transistor, a sixth transistor, a seventh transistor, a first capacitor, a second capacitor, a third capacitor, and a light emitting device;

wherein a gate of the first transistor is electrically connected to a first node, a source of the first transistor is electrically connected to a second node, and a drain of the first transistor is electrically connected to a third node;

wherein a gate of the second transistor is electrically connected to a first control signal, a source of the second transistor is electrically connected to the second node, and a drain of the second transistor is electrically connected to the third node;

wherein a gate of the third transistor is electrically connected to a fourth node, a source of the third transistor is electrically connected to a first power signal, and a drain of the third transistor is electrically connected to the second node;

wherein a gate of the fourth transistor is electrically connected to a second control signal, a source of the fourth transistor is electrically connected to the first power signal, and a drain of the fourth transistor is electrically connected to the fourth node;

wherein a gate of the fifth transistor is electrically connected to the first control signal, a source of the fifth transistor is electrically connected to the first node, and a drain of the fifth transistor is electrically connected to the third node;

wherein a gate of the sixth transistor is electrically connected to a third control signal, a source of the sixth transistor is electrically connected to a data signal, and a drain of the sixth transistor is electrically connected to the first node;

wherein a gate of the seventh transistor is electrically connected to a fourth control signal, a source of the seventh transistor is electrically connected to a reference signal, and a drain of the seventh transistor is electrically connected to the third node;

wherein a first end of the first capacitor is electrically connected to the second node, and a second end of the first capacitor is electrically connected to the fourth node;

wherein a first end of the second capacitor is electrically connected to the first node, and a second end of the second capacitor is electrically connected to the third node;

wherein a first end of the third capacitor is electrically connected to the third node, and a second end of the third capacitor is electrically connected to a second power signal;

wherein an anode of the light emitting device is electrically connected to the third node, and a cathode of the light emitting device is electrically connected to the second power signal; and wherein the first transistor, the second transistor, the third transistor, the fourth transistor, the fifth transistor, the sixth transistor, and the seventh transistor are all low temperature polysilicon thin film transistors, oxide semiconductor thin film transistors, or amorphous silicon thin film transistors, and the light emitting device is an organic light emitting diode.

2. The pixel driving circuit according to claim 1, wherein a combination of the first control signal, the second control signal, the third control signal, and the fourth control signal sequentially corresponds to an initialization phase, a threshold voltage detection phase, a data signal input phase, a programming phase, and an illumination phase, the data signal comprises a reference potential and a display potential, in the initialization phase and the threshold voltage detection phase, a potential of the data signal is the reference potential, and in the data signal input phase, a potential of the data signal is the display potential.

3. The pixel driving circuit according to claim 2, wherein in the initialization phase, the first control signal is at a low potential, the second control signal is at a high potential, the third control signal is at a high potential, and the fourth control signal is at a high potential.

4. The pixel driving circuit according to claim 2, wherein in the threshold voltage detection phase, the first control signal is at a low potential, the second control signal is at a high potential, the third control signal is at a high potential, and the fourth control signal is at a low potential.

5. The pixel driving circuit according to claim 2, wherein in the data signal input phase, the first control signal is at a low potential, the second control signal is at a high potential, the third control signal is at a high potential, and the fourth control signal is at a low potential.

6. The pixel driving circuit according to claim 2, wherein in the programming phase, the first control signal is at a low potential, the second control signal is at a high potential, the third control signal is at a low potential, and the fourth control signal is at a low potential.

7. The pixel driving circuit according to claim 2, wherein in the illumination phase, the first control signal is at a high potential, the second control signal is at a low potential, the third control signal is at a low potential, and the fourth control signal is at a low potential.

8. A pixel driving circuit, comprising:

a first transistor, a second transistor, a third transistor, a fourth transistor, a fifth transistor, a sixth transistor, a seventh transistor, a first capacitor, a second capacitor, a third capacitor, and a light emitting device;

wherein a gate of the first transistor is electrically connected to a first node, a source of the first transistor is electrically connected to a second node, and a drain of the first transistor is electrically connected to a third node;

wherein a gate of the second transistor is electrically connected to a first control signal, a source of the second transistor is electrically connected to the second node, and a drain of the second transistor is electrically connected to the third node;

wherein a gate of the third transistor is electrically connected to a fourth node, a source of the third transistor is electrically connected to a first power signal, and a drain of the third transistor is electrically connected to the second node;

wherein a gate of the fourth transistor is electrically connected to a second control signal, a source of the fourth transistor is electrically connected to the first power signal, and a drain of the fourth transistor is electrically connected to the fourth node;

wherein a gate of the fifth transistor is electrically connected to the first control signal, a source of the fifth transistor is electrically connected to the first node, and a drain of the fifth transistor is electrically connected to the third node;

wherein a gate of the sixth transistor is electrically connected to a third control signal, a source of the sixth transistor is electrically connected to a data signal, and a drain of the sixth transistor is electrically connected to the first node;

wherein a gate of the seventh transistor is electrically connected to a fourth control signal, a source of the seventh transistor is electrically connected to a reference signal, and a drain of the seventh transistor is electrically connected to the third node;

wherein a first end of the first capacitor is electrically connected to the second node, and a second end of the first capacitor is electrically connected to the fourth node;

wherein a first end of the second capacitor is electrically connected to the first node, and a second end of the second capacitor is electrically connected to the third node;

wherein a first end of the third capacitor is electrically connected to the third node, and a second end of the third capacitor is electrically connected to a second power signal; and wherein an anode of the light emitting device is electrically connected to the third node, and a cathode of the light emitting device is electrically connected to the second power signal.

9. The pixel driving circuit according to claim 8, wherein a combination of the first control signal, the second control signal, the third control signal, and the fourth control signal sequentially corresponds to an initialization phase, a threshold voltage detection phase, a data signal input phase, a programming phase, and an illumination phase, the data signal comprises a reference potential and a display potential, in the initialization phase and the threshold voltage detection phase, a potential of the data signal is the reference potential, and in the data signal input phase, a potential of the data signal is the display potential.

10. The pixel driving circuit according to claim 9, wherein in the initialization phase, the first control signal is at a low potential, the second control signal is at a high potential, the third control signal is at a high potential, and the fourth control signal is at a high potential.

11. The pixel driving circuit according to claim 9, wherein in the threshold voltage detection phase, the first control signal is at a low potential, the second control signal is at a high potential, the third control signal is at a high potential, and the fourth control signal is at a low potential.

12. The pixel driving circuit according to claim 9, wherein in the data signal input phase, the first control signal is at a low potential, the second control signal is at a high potential, the third control signal is at a high potential, and the fourth control signal is at a low potential.

13. The pixel driving circuit according to claim 9, wherein in the programming phase, the first control signal is at a low potential, the second control signal is at a high potential, the third control signal is at a low potential, and the fourth control signal is at a low potential.

14. The pixel driving circuit according to claim 9, wherein in the illumination phase, the first control signal is at a high potential, the second control signal is at a low potential, the third control signal is at a low potential, and the fourth control signal is at a low potential.

15. The pixel driving circuit according to claim 8, wherein the first transistor, the second transistor, the third transistor, the fourth transistor, the fifth transistor, the sixth transistor, and the seventh transistor are all low temperature polysilicon thin film transistors, oxide semiconductor thin film transistors, or amorphous silicon thin film transistors.

16. The pixel driving circuit according to claim 8, wherein the light emitting device is an organic light emitting diode.

17. A display panel comprising a pixel driving circuit, wherein the pixel driving circuit comprises:

a first transistor, a second transistor, a third transistor, a fourth transistor, a fifth transistor, a sixth transistor, a seventh transistor, a first capacitor, a second capacitor, a third capacitor, and a light emitting device;

wherein a gate of the first transistor is electrically connected to a first node, a source of the first transistor is electrically connected to a second node, and a drain of the first transistor is electrically connected to a third node;

wherein a gate of the second transistor is electrically connected to a first control signal, a source of the second transistor is electrically connected to the second node, and a drain of the second transistor is electrically connected to the third node;

wherein a gate of the third transistor is electrically connected to a fourth node, a source of the third transistor is electrically connected to a first power signal, and a drain of the third transistor is electrically connected to the second node;

wherein a gate of the fourth transistor is electrically connected to a second control signal, a source of the fourth transistor is electrically connected to the first power signal, and a drain of the fourth transistor is electrically connected to the fourth node;

wherein a gate of the fifth transistor is electrically connected to the first control signal, a source of the fifth transistor is electrically connected to the first node, and a drain of the fifth transistor is electrically connected to the third node;

wherein a gate of the sixth transistor is electrically connected to a third control signal, a source of the sixth transistor is electrically connected to a data signal, and a drain of the sixth transistor is electrically connected to the first node;

wherein a gate of the seventh transistor is electrically connected to a fourth control signal, a source of the seventh transistor is electrically connected to a reference signal, and a drain of the seventh transistor is electrically connected to the third node;

wherein a first end of the first capacitor is electrically connected to the second node, and a second end of the first capacitor is electrically connected to the fourth node;

wherein a first end of the second capacitor is electrically connected to the first node, and a second end of the second capacitor is electrically connected to the third node;

wherein a first end of the third capacitor is electrically connected to the third node, and a second end of the third capacitor is electrically connected to a second power signal; and wherein an anode of the light emitting device is electrically connected to the third node, and a cathode of the light emitting device is electrically connected to the second power signal.

18. The display panel according to claim 17, wherein a combination of the first control signal, the second control signal, the third control signal, and the fourth control signal sequentially corresponds to an initialization phase, a threshold voltage detection phase, a data signal input phase, a programming phase, and an illumination phase, the data signal comprises a reference potential and a display potential, in the initialization phase and the threshold voltage detection phase, a potential of the data signal is the reference potential, and in the data signal input phase, a potential of the data signal is the display potential.

19. The display panel according to claim 18, wherein in the initialization phase, the first control signal is at a low potential, the second control signal is at a high potential, the third control signal is at a high potential, and the fourth control signal is at a high potential.

20. The display panel according to claim 18, wherein in the threshold voltage detection phase, the first control signal is at a low potential, the second control signal is at a high potential, the third control signal is at a high potential, and the fourth control signal is at a low potential.

* * * * *